US008262810B2

(12) United States Patent
Hsu et al.

(10) Patent No.: US 8,262,810 B2
(45) Date of Patent: Sep. 11, 2012

(54) METHOD FOR CONVERSION TREATING SURFACE OF MAGNESIUM ALLOY WORKPIECE

(75) Inventors: Sheng-En Hsu, Tu-Cheng (TW); Yong Liu, Shenzhen (TW); Fei-Xiang Li, Shenzhen (TW); Zhao Jin, Shenzhen (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/045,733

(22) Filed: Mar. 11, 2011

(65) Prior Publication Data

US 2011/0155287 A1 Jun. 30, 2011

Related U.S. Application Data

(62) Division of application No. 12/168,054, filed on Jul. 3, 2008, now Pat. No. 7,942,983.

(30) Foreign Application Priority Data

Dec. 19, 2007 (CN) ..... 2007 1 0203245

(51) Int. Cl.
*C23C 22/57* (2006.01)
*C23C 22/05* (2006.01)

(52) U.S. Cl. ..... 148/253; 148/259; 148/260; 148/262; 148/274; 148/275; 106/14.11; 106/14.12

(58) Field of Classification Search ..... 148/253, 148/259, 260, 262, 274, 275; 106/14.11, 106/14.12
See application file for complete search history.

(56) References Cited

U.S. PATENT DOCUMENTS 2,975,082 A * 3/1961 Henricks ..... 148/259

FOREIGN PATENT DOCUMENTS

TW 499502 8/2002
TW 544474 8/2003

* cited by examiner

*Primary Examiner* — Lois Zheng
(74) *Attorney, Agent, or Firm* — Altis Law Group, Inc.

(57) ABSTRACT

A method for conversion treating a surface of a magnesium alloy workpiece includes the steps of degreasing, acid pickling, alkali pickling, and chemical converting. A phosphating solution is used in the step of chemical converting and includes the following solution concentrations: 2.89 gram/liter to 8.67 gram/liter of phosphoric acid, 0.3 gram/liter to 1.0 gram/liter of carbamide, 0.39 gram/liter to 1.56 gram/liter of nitric acid, 6 gram/liter to 30 gram/liter of manganese dihydrogen phosphate, and 0.2 gram/liter to 0.6 gram/liter of tannin.

11 Claims, 4 Drawing Sheets

| Process | Temperature | Time |
|---|---|---|
| Degreasing | 55 ℃ to 60 ℃ | 4 minutes to 8 minutes |
| 1st water cleaning | Room Temperature | 2 minutes to 19 minutes |
| 2nd water cleaning | Room Temperature | 2 minutes to 19 minutes |
| 3rd water cleaning | Room Temperature | 2 minutes to 19 minutes |
| Acid pickling | 35 ℃ to 45 ℃ | 3 minutes to 5 minutes |
| 1st water cleaning | Room Temperature | 2 minutes to 13 minutes |
| 2nd water cleaning | Room Temperature | 2 minutes to 13 minutes |
| Alkali pickling | 60 ℃ to 80 ℃ | 3 minutes to 5 minutes |
| 1st water cleaning | 30 ℃ to 50 ℃ | 2 minutes to 17 minutes |
| 2nd water cleaning | Room Temperature | 2 minutes to 17 minutes |
| 3rd water cleaning | Room Temperature | 2 minutes to 17 minutes |
| Chemical converting | 35 ℃ to 45 ℃ | 30 seconds to 50 seconds |
| 1st water cleaning | Room Temperature | 2 minutes to 11 minutes |
| 2nd water cleaning | Room Temperature | 2 minutes to 11 minutes |
| 3rd water cleaning | Room Temperature | 2 minutes to 11 minutes |
| Drying | 110 ℃ to 150 ℃ | 30 minutes to 70 minutes |

FIG. 2

| Steps \ Recipes | Solutions | Concentration (g/L) | | |
|---|---|---|---|---|
| | | A | B | C |
| Acid pickling | citric acid | 8 | 10 | 15 |
| | surface active agent | 3 | 3 | 4 |
| Alkali pickling | KOH | 100 | 120 | 150 |
| Chemical converting | $H_3PO_4$ | 4.34 | 5.78 | 6.5 |
| | $(NH_2)_2CO$ | 0.4 | 0.5 | 0.6 |
| | $HNO_3$ | 0.94 | 0.78 | 0.62 |
| | $Mn(H_2PO_4)_2$ | 10 | 15 | 18 |
| | tannic acid | 0.4 | 0.5 | 0.55 |

FIG. 3

| Samples | Recipes | Surface Resistance (ohm) | Corrosion Resistance | Bonding Strength |
|---|---|---|---|---|
| 1st group | A column | 1.25, 1.42, 1.35 | 8, 9, 9 grade/8hours | 4B, 5B, 5B |
| 2nd group | B column | 0.74, 1.54, 1.65 | 9, 9, 9 grade/8hours | 5B, 5B, 5B |
| 3rd group | C column | 0.87, 1.34, 0.76 | 9, 9, 9 grade/8hours | 5B, 5B, 5B |

FIG. 4

METHOD FOR CONVERSION TREATING SURFACE OF MAGNESIUM ALLOY WORKPIECE

CROSS-REFERENCE TO RELATED APPLICATION

This application is a divisional application of U.S. patent application Ser. No. 12/168,054, filed on Jul. 3, 2008, now U.S. Pat. No. 7,942,983, which claims foreign priority based on Chinese Patent application No. 200710203245.4, filed in China on Dec. 19, 2007. The contents of each of the above-mentioned patent applications is hereby incorporated by reference herein in its entirety and made a part of this specification.

BACKGROUND

1. Technical Field

The present invention relates methods for conversion treating surface of magnesium alloy workpieces.

2. Discussion of Related Art

Magnesium is a metal that is the lightest in weight among metal materials. Magnesium alloys are composed of the magnesium and some other metals, such as aluminum and zinc. In recent years, there has been an increase in demand for magnesium alloys used as structural materials for electronic products and vehicles.

The magnesium alloy may easily react with other chemical substances such as acids, thus, a protective layer is normally needed to be formed on the surfaces of magnesium alloy workpieces. A phosphating film is generally formed on an outer surface of a magnesium alloy workpiece to protect the magnesium alloy workpiece.

The phosphating film is formed by a method for conversion treating surface of the magnesium alloy workpiece. Typically, the method includes a chemical converting step. However, the thickness of the phosphating film formed during the chemical converting step is not easily regulated, and frequently, a corrosion resistance or a surface resistance film is not being satisfactorily formed on the magnesium alloy workpiece to meet the requirements.

Therefore, a phosphating solution and method for conversion treating surface of a magnesium alloy workpiece are desired in order to overcome the above-described shortcomings.

SUMMARY

A phosphating solution is used for conversion treating a surface of a magnesium alloy workpiece. The phosphating solution includes: 2.89 gram/liter to 8.67 gram/liter of phosphoric acid, 0.3 gram/liter to 1.0 gram/liter of carbamide, 0.39 gram/liter to 1.56 gram/liter of nitric acid, 6 gram/liter to 30 gram/liter of manganese dihydrogen phosphate, and 0.2 gram/liter to 0.6 gram/liter of tannin.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present phosphating solution and method for conversion treating surface of the magnesium alloy workpiece. Moreover, in the drawings, like reference numerals designate corresponding parts throughout several views.

FIG. 2 is a table showing a plurality of temperatures and times for the different steps in the method of FIG. 1.

FIG. 3 is a table showing a plurality of recipes of acid pickling solutions, alkaline solutions, and phosphating solutions, respectively.

FIG. 4 a table showing the test results of the samples.

DETAILED DESCRIPTION OF THE EMBODIMENT

Figure 1:
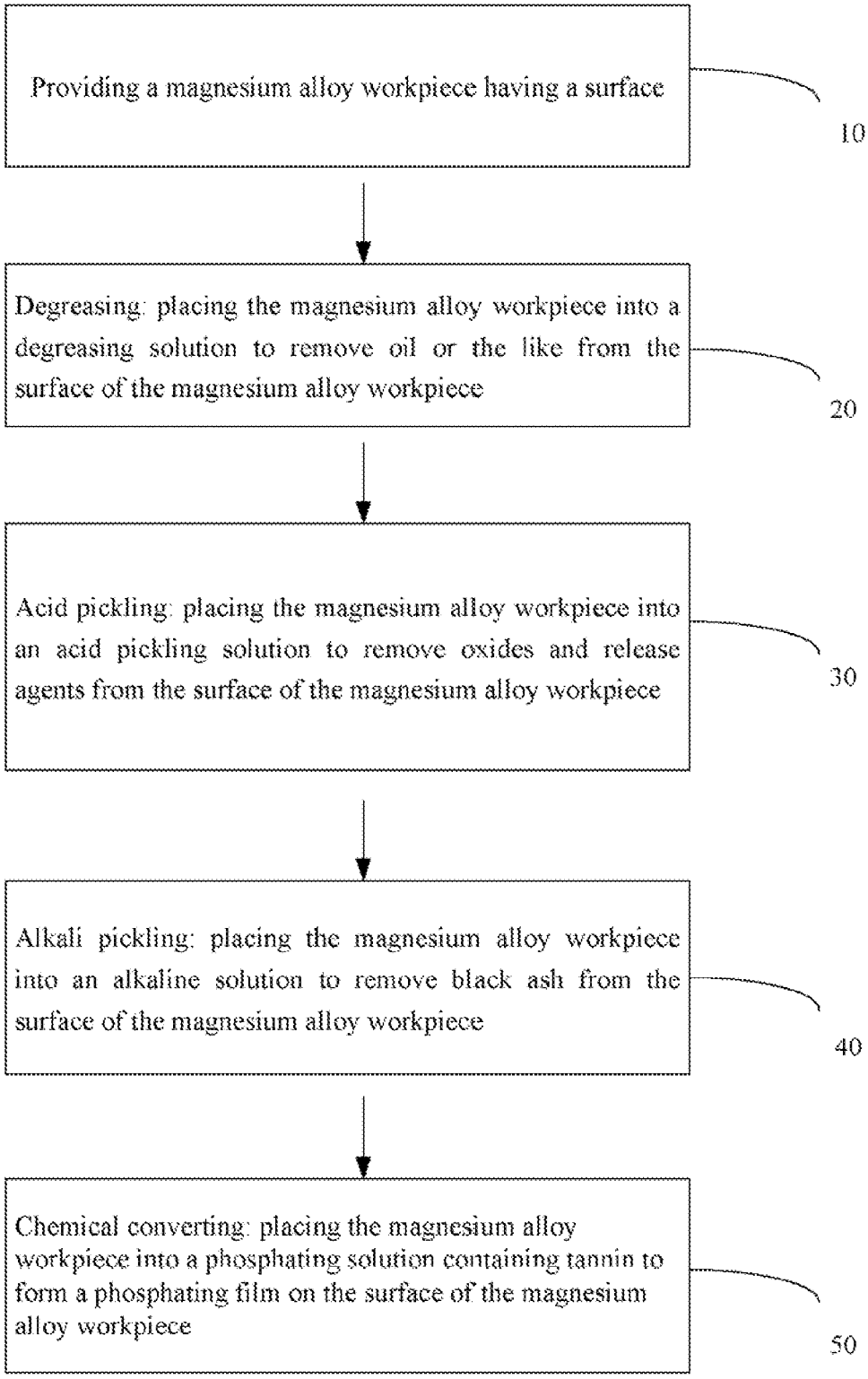
FIG. 1 is a flowchart of a method for conversion treating surface of a magnesium alloy workpiece in accordance with an exemplary embodiment of the present invention.

Reference will now be made to the drawings to describe preferred embodiments of the present magnesium alloy workpiece, and method for making the same, in detail.

Referring to FIG. 1, a flowchart of a method for conversion treating surface of a magnesium alloy workpiece according an exemplary embodiment is shown. The method includes the following steps:

Step 10, providing a magnesium alloy workpiece having a surface.

Step 20, degreasing: placing the magnesium alloy workpiece into a degreasing solution to remove oil or the like from the surface of the magnesium alloy workpiece.

Step 30, acid pickling: placing the magnesium alloy workpiece into an acid pickling solution to remove oxides and release agents from the surface of the magnesium alloy workpiece.

Step 40, alkali pickling: placing the magnesium alloy workpiece into an alkaline solution to remove black ash from the surface of the magnesium alloy workpiece.

Step 50, chemical converting: placing the magnesium alloy workpiece into a phosphating solution containing tannin to form a phosphating film on the surface of the magnesium alloy workpiece.

The method for conversion treating surface of the magnesium alloy workpiece is explained in detail below by referring to FIG. 2.

In step 20, a time period of which the magnesium alloy workpiece is placed in the degreasing solution is in a range from about 4 minutes to about 8 minutes, and a temperature of the degreasing solution is in range from about 55 degrees centigrade to about 65 degrees centigrade. The degreasing solution comprises of sodium hydroxide (NaOH) or sodium phosphate ($Na_3PO_4$) and water ($H_2O$). It should be pointed that, if the magnesium alloy workpiece has been treated with a sand blastering process, the oils or the like on the surface of the magnesium alloy workpiece have already been removed during the sand blastering process, and the step 20 can be omitted.

In step 30, a time period of which the magnesium alloy workpiece is placed in the acid pickling solution is in a range from about 3 minutes to about 5 minutes, and a temperature of the acid pickling solution is in a range from about 35 degrees centigrade to about 45 degrees centigrade. The acid pickling solution comprises of citric acid, surface active agent, and water ($H_2O$). The surface active agent is water soluble and silicone free. A concentration of the citric acid is in a range from 5 gram/liter to 30 gram/liter. A concentration of the surface active agent (industrial grade) is in a range from 1.5 gram/liter to 6 gram/liter.

The citric acid may react with and remove the oxides and the release agent from the surface of the magnesium alloy workpiece. The oxides can be magnesia (MgO), alumina ($Al_2O_3$), and zinc oxide (ZnO). The release agents include a resin represented by a formula: $(CH_2)_m$—$CH(Si)_n$—COOR, wherein, R represents a functional group such as methyl. The citric acid may also prevent the black ash (the main gradient of the black ash is Al and Zn) from forming on the surface of the magnesium alloy workpiece to a certain extent. A concentration of the citric acid is in a range from 8 gram/liter to 15 gram/liter. When the magnesium alloy workpiece is placed into the acid pickling solution, the following chemical reactions may occur:

$$MgO+2H^+=Mg^{2+}+H_2O;$$

$$Al_2O_3+6H^+=2Al^{3+}+3H_2O;$$

$$ZnO+2H^+=Zn^{2+}+H_2O;$$

$$Mg+2H^+=Mg^{2+}+H_2;$$

$$(CH_2)_m—CH(Si)_n—COOR+H^+=R^++(CH_2)_m—CH(Si)_n—COOH.$$

The surface active agent may be used as a buffer, so as to prevent excessive corrosion to the magnesium alloy workpiece. The surface active agent includes a hydrophilic group, such as a hydroxyl. The surface active agent can be a polyalcohol, such as poly ethylene glycol, glycerol, neopentyl glycol, sucrose, dextrose, or sorbitol. A concentration of the surface active agent is in a range from 3 gram/liter to 4 gram/liter.

In step 40, a time period of which the magnesium alloy workpiece is placed in the alkaline solution is in a range from about 3 minutes to about 5 minutes, and a temperature of the alkaline solution is in a range from about 60 degrees centigrade to about 80 degrees centigrade. A solute of the alkaline solution can be potassium hydroxide (KOH) or sodium hydroxide (NaOH).

The alkaline solution is mainly used to react with and remove the black ash from the surface of the magnesium alloy workpiece such that a base of the magnesium alloy workpiece is exposed. When the solute is KOH (industrial grade), a concentration of the KOH is in a range from 60 gram/liter to 180 gram/liter. Preferably, a concentration of the KOH is in the range from 100 gram/liter to 150 gram/liter. When the magnesium alloy workpiece is placed into the alkaline solution, the following chemical reactions may occur:

$$6KOH+2Al=2K_3AlO_3+3H_2;$$

$$2KOH+Zn=K_2ZnO_2+H_2.$$

In step 50, a time period of which the magnesium alloy workpiece is placed in the phosphating solution is in a range from about 30 seconds to about 50 seconds, and a temperature of the phosphating solution is in a range from about 35 degrees centigrade to about 45 degrees centigrade. The thickness of the phosphating film formed on the surface of the workpiece can be in a range from 5 microns to 30 microns. A surface resistance of the phosphating film formed on the magnesium alloy workpiece is less than 2 ohms. The phosphating solution can include 2.89 gram/liter to 8.67 gram/liter of phosphoric acid ($H_3PO_4$) (industrial grade), 0.3 gram/liter to 1.0 gram/liter of carbamide ($(NH_2)_2CO$) (Analytical Reagent Grade), 0.39 gram/liter to 1.56 gram/liter of nitric acid ($HNO_3$) (industrial grade), 2 gram/liter to 30 gram/liter of manganese dihydrogen phosphate ($Mn(H_2PO_4)_2$) (industrial grade), and 0.2 gram/liter to 0.6 gram/liter of tannin ($C_{76}H_{52}O_{46}$) (Analytical Reagent Grade).

The $H_3PO_4$ is used to provide $PO_4^{3+}$ ions. To further regulate a thickness of the phosphating film formed on the surface of the workpiece, the concentration of the $H_3PO_4$ is, preferably, in the range from 4.34 gram/liter to 6.5 gram/liter.

The $(NH_2)_2CO$ is used to make the phosphating film uniformly. To prevent the phosphating film from developing/forming too slowly, the concentration of the $(NH_2)_2CO$ is, preferably, in the range from 0.4 gram/liter to 0.6 gram/liter.

The $HNO_3$ is used to provide $H^+$ ions to adjust a PH value of the phosphating solution to be in a range from about 6.5 to about 9.5. Preferably, the concentration of the $HNO_3$ is in the range from 0.62 gram/liter to 0.94 gram/liter.

The $Mn(H_2PO_4)_2$ is used to provides $Mn^{2+}$, $PO_4^{3+}$, and $H^+$ ions. To further regulate to form a more uniform thickness of the phosphating film on the surface of the workpiece, the concentration of the $Mn(H_2PO_4)_2$ is, preferably, in the range from 10 gram/liter to 18 gram/liter.

The tannin is used to improve the bonding strength between the phosphating film and a painting layer coated on the phosphating film. Preferably, the concentration of the tannin is in the range from 0.4 gram/liter to 0.55 gram/liter.

The phosphating film mainly includes composite phosphates including $Mg_3(PO_4)_2$, $Mn_3(PO_4)_2$, and so on. When the magnesium alloy workpiece is placed into the phosphating solution, the following chemical reactions may occur;

$$Mg+2H^+=Mg^{2+}+H_2;$$

$$3Mg^{2+}+2PO_4^{3-}=Mg_3(PO_4)_2;$$

$$3Mn^{2+}+2PO_4^{3-}=Mn_3(PO_4)_2.$$

The formula of the composite phosphate can be:

$$(Mg^{2+})_A(Mn^{2+})_B(NO^{3-})_C(Zn^{2+})_D(PO_4^{3-})_E\ldots$$

It can be understood that, the method can further include a water cleaning step after the step 20, step 30, step 40, and step 50 respectively. In addition, the method may include a drying process after the step 50. The magnesium alloy workpiece can be dried at a temperature in a range from about 110 degrees centigrade to about 150 degrees centigrade for a time period in a range from about 30 minutes to about 70 minutes.

Examples of methods for conversion treating surface of the magnesium alloy workpieces are described as follows.

Three groups ($1^{st}$ group, $2^{nd}$ group, and $3^{rd}$ group, each including three magnesium alloy workpieces) of magnesium alloy workpieces are provided. A material of each of the magnesium alloy workpiece is AZ91D. The three groups of magnesium alloy workpieces are treated with the processes shown in FIG. 2 correspondingly, thereby yielding three groups of samples of magnesium alloy products. As shown in FIG. 3, Recipes (A column, B column, and C column) of acid pickling solutions, alkaline treatment solutions, and phosphating solutions are used during the corresponding processes of the three sample groups ($1^{st}$ group, $2^{nd}$ group, and $3^{rd}$ group) of magnesium alloy workpiece.

Corrosion resistance of the samples is evaluated by a salt spray tester. A salt spray test solution used in the salt spray tester includes 5% of sodium chloride (NaCl). Surface resistances of the samples of the magnesium alloy products are evaluated by using micro-ohmmeter. Bonding strength of the samples of the magnesium alloy products is evaluated by cross-cut test after an outer coating is formed on the phosphating film. Referring to FIG. 4, a test result of the samples is shown. Corrosion resistance of the samples of the magnesium alloy products are all above grade 8, the surface resistances of the samples of the magnesium alloy products are all less than 2 ohms, and the bonding strength of the samples of the magnesium alloy products are all above 3B grade. Therefore, the magnesium alloy products all have good corrosion resistance, relatively high bonding strength, and lower surface resistance. It is understood that, if the magnesium alloy products are used to make a portable electronic devices, the portable electronic devices may have a good electromagnetic interference shielding efficiency.

Finally, while various embodiments have been described and illustrated, the invention is not to be construed as being limited thereto. Various modifications can be made to the embodiments by those skilled in the art without departing from the true spirit and scope of the invention as defined by the appended claims.

What is claimed is:

1. A method for conversion treating a surface of a magnesium alloy workpiece, the method comprising the steps of degreasing, acid pickling, alkali pickling, and chemical converting, wherein a phosphating solution used in the step of chemical converting comprises: 2.89 gram/liter to 8.67 gram/liter of phosphoric acid, 0.3 gram/liter to 1.0 gram/liter of carbamide, 0.39 gram/liter to 1.56 gram/liter of nitric acid, 6 gram/liter to 30 gram/liter of manganese dihydrogen phosphate, and 0.2 gram/liter to 0.6 gram/liter of tannin.

2. The method for conversion treating the surface of the magnesium alloy workpiece as claimed in claim 1, wherein the phosphoric acid is in the range from 4.34 gram/liter to 6.50 gram/liter.

3. The method for conversion treating the surface of the magnesium alloy workpiece as claimed in claim 1, wherein the carbamide is in the range from 0.4 gram/liter to 0.6 gram/liter.

4. The method for conversion treating the surface of the magnesium alloy workpiece as claimed in claim 1, wherein the nitric acid is in the range from 0.62 gram/liter to 0.94 gram/liter.

5. The method for conversion treating the surface of the magnesium alloy workpiece as claimed in claim 1, wherein the manganese dihydrogen phosphate is in the range from 10 gram/liter to 18 gram/liter.

6. The method for conversion treating the surface of the magnesium alloy workpiece as claimed in claim 1, wherein the tannin is in the range from 0.4 gram/liter to 0.55 gram/liter.

7. The method for conversion treating the surface of the magnesium alloy workpiece as claimed in claim 1, wherein a PH value of the phosphating solution is in the range from about 6.5 to about 9.5.

8. The method for conversion treating the surface of the magnesium alloy workpiece as claimed in claim 1, wherein the degreasing step comprises placing the magnesium alloy workpiece into a degreasing solution.

9. The method for conversion treating the surface of the magnesium alloy workpiece as claimed in claim 1, wherein the acid pickling step comprises placing the magnesium alloy workpiece into an acid pickling solution.

10. The method for conversion treating the surface of the magnesium alloy workpiece as claimed in claim 1, wherein the alkali pickling step comprises placing the magnesium alloy workpiece into an alkaline solution.

11. The method for conversion treating the surface of the magnesium alloy workpiece as claimed in claim 1, further comprising the step of water cleaning.

* * * * *